United States Patent [19]

Cook

[11] Patent Number: 4,786,852

[45] Date of Patent: Nov. 22, 1988

[54] INVERTER OPERATED TURBINE ENGINE STARTING SYSTEM

[75] Inventor: Alexander Cook, Rockford, Ill.

[73] Assignee: Sundstrand Corporation, Rockford, Ill.

[21] Appl. No.: 169,141

[22] Filed: Mar. 10, 1988

Related U.S. Application Data

[63] Continuation of Ser. No. 886,874, Jul. 18, 1986, abandoned.

[51] Int. Cl.[4] ..... F02N 11/00

[52] U.S. Cl. ..... 322/10; 322/14; 290/31; 290/38 R; 363/37

[58] Field of Search ..... 322/10, 11, 12, 13, 322/14, 15, 16; 363/37, 68; 290/22, 31, 38

[56] References Cited

U.S. PATENT DOCUMENTS

| | | | |
|---|---|---|---|
| 3,908,130 | 9/1975 | Lafuze | 290/31 |
| 4,119,861 | 10/1978 | Gocho | 322/32 |
| 4,330,743 | 5/1982 | Glennon | 322/10 |
| 4,456,830 | 6/1984 | Cronin | 290/32 |
| 4,481,459 | 11/1984 | Mehl et al. | 322/10 |
| 4,572,961 | 2/1986 | Borger | 290/4 R |
| 4,620,272 | 10/1986 | Fulton et al. | 363/37 |
| 4,695,776 | 9/1987 | Dishner et al. | 290/4 C |

*Primary Examiner*—Patrick R. Salce
*Assistant Examiner*—Anita M. Ault
*Attorney, Agent, or Firm*—Wood, Dalton, Phillips, Mason & Rowe

[57] ABSTRACT

Engine start capability may be added to an aircraft generating system including a variable speed, constant frequency inverter 34 by placing transistors 48 in shunt relation to diodes 22 forming part of a full wave rectifier for rectifying A.C. power from a brushless generator output winding 10 which is normally supplied to the inverter 34 for conversion to constant frequency A.C. power. A source of D.C. power 60 may be connected to the diodes 22 and transistors 48 and the latter are operated by an inverter controller 52 to convert the D.C. power so provided to alternating current to be fed to the brushless generator output windings 10 and cause the brushless generator to operate as an A.C. motor for the starting of a turbine engine 18 or the like.

3 Claims, 2 Drawing Sheets

INVERTER OPERATED TURBINE ENGINE STARTING SYSTEM

This application is a continuation of application Ser. No. 886,874 filed 7/18/86 now abandoned.

FIELD OF THE INVENTION

This invention relates to a starting system for turbine engines such as those employed in aircraft, and more specifically, a starting system which makes substantial use of existing components of a generating system associated with the turbine engine.

BACKGROUND OF THE INVENTION

Turbine engines utilized in, for example, aircraft, have been started in any of a variety of ways. One typical starting scheme may utilize an air turbine connected in driving relation to the turbine engine. When it is desired to start the turbine engine, the air turbine is provided with air under pressure from an auxiliary power unit (APU) and driven until it in turn brings the turbine engine up to a self sustaining speed.

One difficulty with this approach is the fact that the air turbine is permanently connected to the turbine engine. Its presence thus adds weight to the aircraft reducing its useful load. Furthermore, in many instances, the presence of the air turbine may increase the frontal area of the turbine engine housing which thus increases aerodynamic drag, thus decreasing aircraft efficiency.

Electrical starters have also been utilized. Inasmuch as most aircraft of a size and capacity sufficient to justify the use of one or more turbine engines require a relatively high output electrical generating system to be driven by the turbine engine, there have been a number of proposals whereby the generator can be operated as a motor during an engine start mode and thus used to drive the turbine engine up to self sustaining speed. Power for the generator when utilized as a motor may be supplied by an APU or from the generating system of already running turbine engine in a multiple engine aircraft.

Electrical systems of this type have been fairly successful for their intended purpose. In many instances, however, the same utilize constant speed drives interconnecting the turbine engine and the generator and some mechanical provision must be made for operating a constant speed drive in reverse or bypassing the same during the engine start mode period. This generally requires the addition of mechanical components which, by reason of the nature of the forces involved, must be of fairly rugged construction and which in turn add weight to the aircraft. In some instances, the additional bulk of such components may even increase the frontal area of the engine housing leading to an increase in aerodynamic drag.

There are other types of generating systems employed in aircraft such as a so-called VSCF system. The name refers to a variable speed, constant frequency inverter system. It is desirable to provide a means for such a system whereby the generator in such a system can be alternatively used as a starter for starting an associated turbine engine. The present invention is directed to accomplishing that result in a system with minimum mass and a minimized efficiency penalty.

SUMMARY OF THE INVENTION

It is a principal object of the invention to provide a new and improved starter-generating system for use with turbine engines such as are employed in aircraft. More specifically, it is an object of the invention to provide such a system for use in a generating system employing a variable speed, constant frequency inverter in such a way as to minimize mass and any efficiency penalty required to implement starting capability.

An exemplary embodiment of the invention achieves the foregoing object in a generating system including a brushless generator coupled to the turbine and having at least one plural phase output winding in which electrical power may be induced by a magnetic field produced in a main field powered by an exciter. A full wave rectifier including two diodes for each phase and interconnected in a bridge which is connected to the winding and is adapted to provide a DC output for use in system is also included. According to the invention, the generator is utilized as an A.C. synchronous starting motor for the turbine through the use of a plurality of semiconductors, one for each diode, each having a conduction path connected in shunt relation to the corresponding diode within the bridge. An inverter controller is connected to the control electrode of the semiconductors for selectively operating the semiconductors so that the semiconductors in the diodes operate as an inverter. The system is completed by the provision of means for selectively applying a D.C. signal to the bridge oppositely of the winding.

As a consequence, the only additional mass added to an already existent generating system in order to cause the same to operate as a starter system involves addition of the semiconductors and the control therefor.

In a highly preferred embodiment, the semiconductors are transistors and the conduction path is the emitter-collector conduction path and the control electrode is the base.

The invention contemplates that the foregoing components be utilized in a system further including a variable speed, constant frequency inverter for providing an A.C. signal and connected to the bridge oppositely of the winding, that is, on the same side as the means for selectively applying a D.S. signal.

Other objects and advantages will become apparent from the following specification taken in connection with the accompanying drawings.

DESCRIPTION OF THE PRIOR ART

Figure 1:
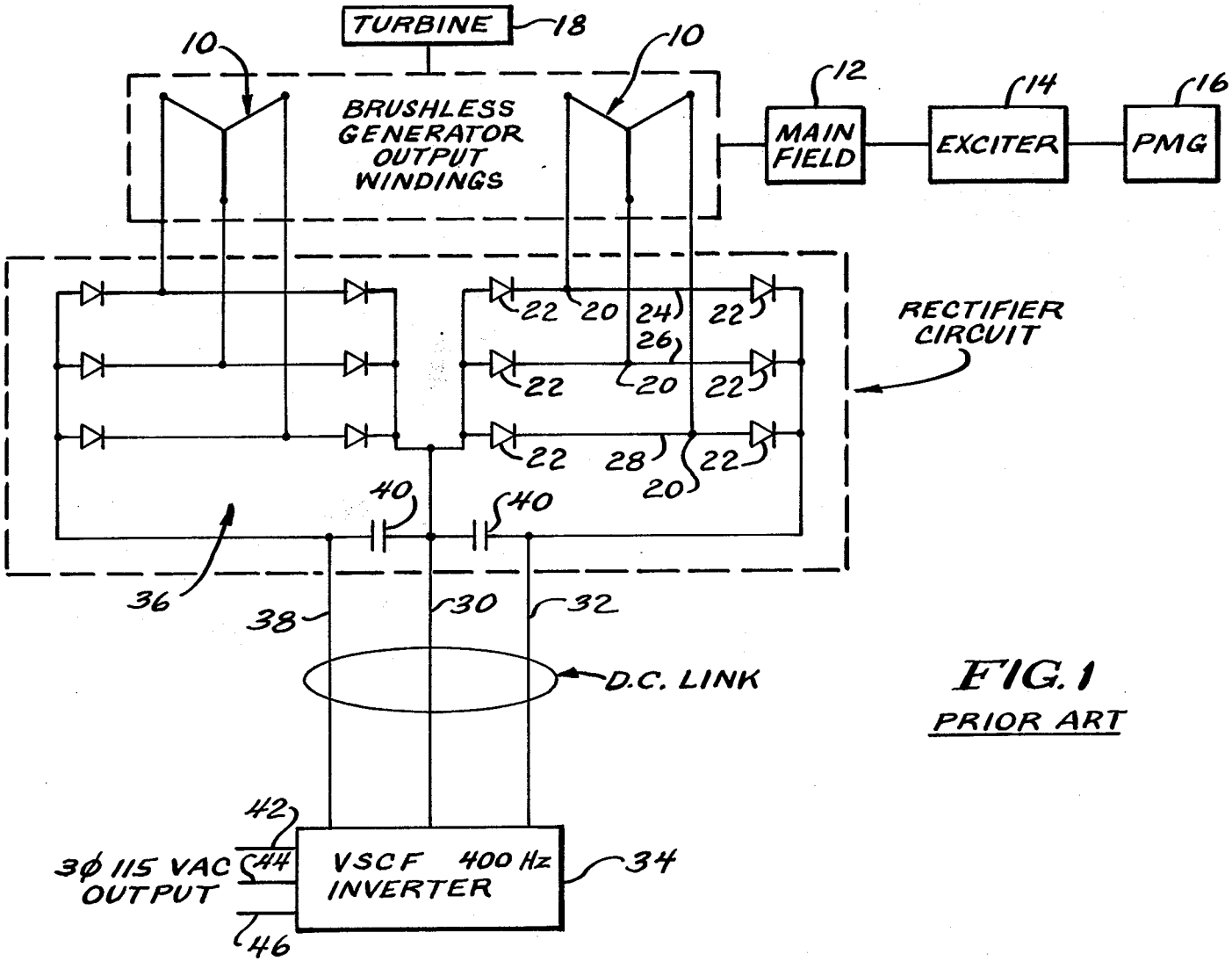
FIG. 1 PRIOR ART
FIG. 1 is a schematic view of an existent generating system for operation by a turbine engine such as an aircraft turbine engine utilizing a variable speed, constant frequency inverter.

A typical prior art power generating system of the type employing a variable speed, constant frequency inverter is illustrated in FIG. 1. The same will be described in that the invention is specifically directed to providing such a system with an engine start capability.

The system illustrated in FIG. 1 includes a wound field, wild frequency brushless generator of conventional construction, which, as is well known, includes one or more generator output windings 10. As illustrated in FIG. 1, two such windings are provided and each is a star connected, three-phase winding. Electrical power is induced in the windings 10 as a result of a rotating field, frequently termed the "main field" carried by the generator rotor and designated 12. The main field creates the rotating magnetic field and the magnetic field is in turn generated by electrical power provided by an exciter 14 which in turn is conventionally powered by a permanent magnet generator 16. All of these components form a part of the brushless generator and may be driven, when operated in a generating mode, by a turbine engine 18 connected to the generator rotor.

Conventionally, each branch of each winding 10 is connected to a junction 20 between two diodes 22. Thus, there are provided two of the diodes 22 for each of the phases provided by the output windings 10 when the device is operated as a generator. The diodes 22 are arranged with the polarities illustrated and form a bridge of three branches 24, 26, and 28, one for each phase. The branches 24, 26 and 28 are connected in parallel to form the bridge and the sides of each of the diodes 22 remote from the connection points 20 are connected to lines 30 and 32, respectively, which are provided to a conventional variable speed, constant frequency inverter 34. Where the brushless generator includes more than one of the windings 10 such as illustrated in FIG. 1 an additional bridge 36 made up in the same form as mentioned previously is provided for each winding and the same is connected to the inverter via the line 30 as well as the line 38. Capacitors 40 employed for conventional purposes interconnect the lines 30 and 32, and 30 and 38, respectively.

As a result of the foregoing, upon operation of the turbine, the brushless generator will be operated and the same will have a frequency output that varies according to the speed of the turbine 18. The output power of varying frequency is rectified to direct current by the bridge circuits thus described and provided as an input to the inverter 34. The inverter is controlled and operated in the conventional fashion, and, when employed in an aircraft, will typically provide a three-phase, 115 volts A.C., 400 hertz output on output lines shown at 42, 44 and 46.

DESCRIPTION OF THE PREFERRED EMBODIMENT

Figure 2:
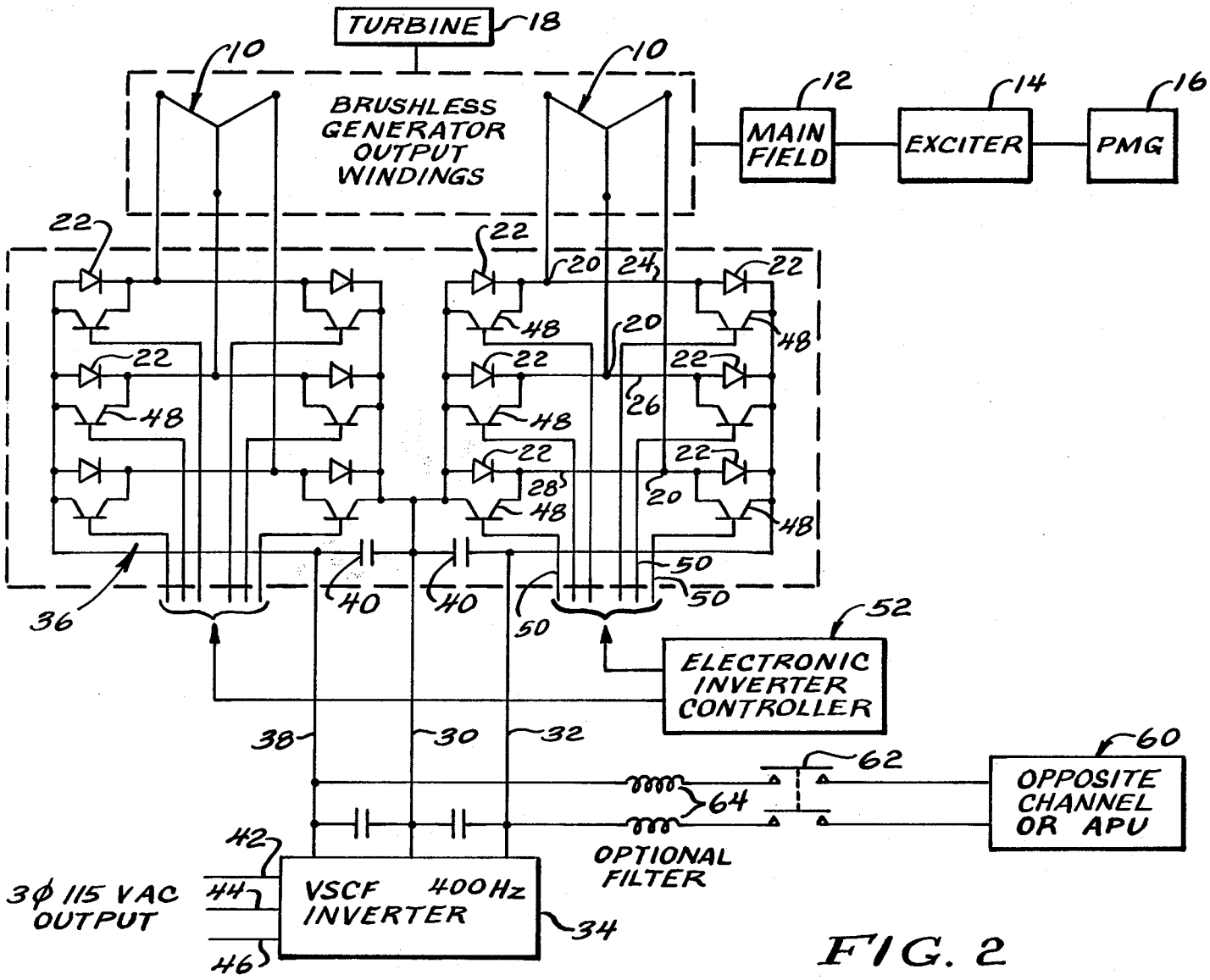
FIG. 2 is a schematic similar to FIG. 1 but illustrating the additional components added according to the invention to convert a rectifier bridge found in the prior art into an inverter so as to allow the system to be utilized for starting in addition to power generation.

An exemplary embodiment of a generating system such as shown in FIG. 1 and provided with engine start capability according to the invention is illustrated in FIG. 2. Where like components are utilized, like reference numerals are given. Moreover, in the interest of brevity, components common to the prior art system already described will not be redescribed.

According to the invention, a semiconductor, such as a transistor 48, is placed in shunt relation with each of the diodes 22 in each of the branches 24, 26 and 28 of each bridge. That is to say, a transistor 48 is connected in parallel with each diode, there being a number of transistors 48 equal to the number of diodes 22 in each bridge. The arrangement is such that the collector-emitter conduction path of each transistor 48 is in parallel with the corresponding diode 22. At the same time, the control electrode or base of each transistor 48 is connected to a corresponding control line 50. The control lines 50 are taken to a conventional electronic inverter controller, shown generally at 52. Through conventional operation of the controller 52, the transistors 48 may be caused to operate generally as in the inverter 34 with the diodes 22 acting as flywheel diode to dissipate stored energy when their corresponding transistors 48 are turned off.

When it is desired to start the turbine 18, the brushless generator is operated as an A.C., synchronous motor with the alternating current being provided to the windings 10 from the bridges when operating as inverters. D.C. power to the bridges is provided on the lines 30, 32 and 38 from any suitable source, generally designated 60, connected appropriately to the lines via a selectively operable switch 62. Optional filters 64 may be employed in the connection if desired.

The source 60 may be an auxiliary power unit or it may be the output found on the lines 30, 32 and 38 of a generating system associated with another turbine 18 in a multi-engine aircraft, which turbine is already running.

Those skilled in the art will realize that the inverter circuit formed utilizing the transistors 48 and the diode 22 will not provide particularly "clean" A.C. power. However, it will be more than adequate for powering the windings 10 so that the brushless generator may operate as an A.C. motor. More importantly, an engine start capability is added to the system with only minimal weight addition, requiring only the addition of the transistors 48 and the controller 52.

It will also be appreciated that operation of the start system bypasses entirely the A.C. components of the electrical and generating system so that start system operation does not cause degredation of A.C. power available from the generating system.

Because only crude inverter capabilities may be utilized to provide A.C. power to the brushless generator for operation as a motor, a number of electrical components including capacitors that are typically employed with inverters to provide clean power, but which cut down on power efficiency, can be avoided to maximize the efficiency of operation of the system.

I claim:

1. In a generating system for an aircraft turbine or the like including a brushless generator coupled to the turbine and having at least one plural phase output winding in which electrical power may be induced by a magnetic field produced in a main field powered by an exciter; a full wave rectifier comprising two diodes for each phase interconnected in a bridge which is connected to said winding, and a variable speed constant frequency inverter for providing an A.C. signal and connected to said bridge oppositely of said winding, the improvement wherein said generator may be utilized as an A.C. synchronous starting motor for said turbine and comprising:

a plurality of transistors, one for each diode, each having its emitter-collector conduction path connected in shunt relation to the corresponding diode within said bridge;

an inverter controller connected to the bases of said transistors to selectively drive said transistors so that said transistors and diodes may operate as an inverter;

and means for selectively applying a D.C. signal to said bridge oppositely of said winding.

2. In a generating system for an aircraft turbine or the like including a brushless generator coupled to the turbine and having at least one plural phase output winding in which electrical power may be induced by a magnetic field produced in a main field powered by an exciter; and a full wave rectifier comprising two diodes for each phase interconnected in a bridge which is connected to said winding and adapted to provide a D.C. output for use in said system;

the improvement wherein said generator may be utilized as an A.C. synchronous starting motor for said turbine and comprising:

a plurality of transistors, one for each diode, each having its emitter-collector conduction path connected in shunt relation to the corresponding diode within said bridge;

an inverter controller connected to the bases of said transistors to selectively drive said transistors so that said transistors and diodes may operate as an inverter;

and means for selectively applying a D.C. signal to said bridge oppositely of said winding.

3. In a generating system for an aircraft turbine or the like including a brushless generator coupled to the turbine and having at least one plural phase output winding in which electrical power may be induced by a magnetic field produced in a main field powered by an exciter; a full wave rectifier comprising two diodes for each phase interconnected in a bridge which is connected to said winding, and a variable speed constant frequency inverter for providing an A.C. signal and connected to said bridge oppositely of said winding, the improvement wherein said generator may be utilized as an A.C. synchronous starting motor for said turbine comprising:

a plurality of semiconductors, one for each diode, each having a conduction path connected in shunt relation to the corresponding diode within said bridge;

an inverter controller connected to a control electrode of each of said semiconductors to selectively operate said semiconductor so that said semiconductors and said diodes may operate as an inverter;

and means for selectively applying a D.C. signal to said bridge oppositely of said winding.

* * * * *